US011177602B2

(12) United States Patent
Nishijima

(10) Patent No.: US 11,177,602 B2
(45) Date of Patent: Nov. 16, 2021

(54) FEMALE TERMINAL

(71) Applicants: AUTONETWORKS TECHNOLOGIES, LTD., Yokkaichi (JP); SUMITOMO WIRING SYSTEMS, LTD., Yokkaichi (JP); SUMITOMO ELECTRIC INDUSTRIES, LTD., Osaka (JP)

(72) Inventor: Seido Nishijima, Yokkaichi (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/970,125

(22) PCT Filed: Feb. 12, 2019

(86) PCT No.: PCT/JP2019/004781
§ 371 (c)(1),
(2) Date: Aug. 14, 2020

(87) PCT Pub. No.: WO2019/167599
PCT Pub. Date: Sep. 6, 2019

(65) Prior Publication Data

US 2020/0403342 A1 Dec. 24, 2020

(30) Foreign Application Priority Data

Mar. 2, 2018 (JP) ..... JP2018-037699
Apr. 10, 2018 (JP) ..... JP2018-075671

(51) Int. Cl.
*H01R 13/02* (2006.01)
*H01R 13/193* (2006.01)
(Continued)

(52) U.S. Cl.
CPC ..... *H01R 13/193* (2013.01); *H01R 4/48* (2013.01); *H01R 13/187* (2013.01); *H01R 2201/26* (2013.01)

(58) Field of Classification Search
CPC .... H01R 13/193; H01R 13/187; H01R 13/20; H01R 13/15; H01R 13/10; H01R 13/02;
(Continued)

(56) References Cited

U.S. PATENT DOCUMENTS 5,167,516 A * 12/1992 Tan ..... H01R 13/631 439/141
5,848,912 A * 12/1998 Okabe ..... H01R 13/6275 439/489
(Continued)

FOREIGN PATENT DOCUMENTS

DE 102007016333 A1 10/2008
EP 2675017 A1 12/2013
(Continued)

OTHER PUBLICATIONS

Apr. 23, 2019 International Search Report issued in International Patent Application No. PCT/JP2019/004781.

*Primary Examiner* — Harshad C Patel
(74) *Attorney, Agent, or Firm* — Oliff PLC

(57) ABSTRACT

A female terminal, including: a female terminal fitting including a connector to be conductively connected to a male terminal; a facing member held on the female terminal fitting, the facing member being arranged to face the connector across a male terminal insertion gap into which the male terminal is inserted; a spring held on the female terminal fitting, the spring biasing at least one of the facing member and the connector toward the other; and an approach displacement restricting device that maintains the male terminal insertion gap by restricting a displacement in
(Continued)

an approaching direction between the facing member and the connector.

11 Claims, 8 Drawing Sheets

(51) Int. Cl.
*H01R 4/48* (2006.01)
*H01R 13/187* (2006.01)

(58) Field of Classification Search
CPC ..... H01R 13/04; H01R 13/005; H01R 13/11; H01R 13/516; H01R 13/514; H01R 13/46; H01R 4/48
USPC ..... 439/823, 856, 851, 853, 854, 855, 578, 439/345, 346, 362, 364, 619, 660, 678, 439/699.1, 708, 723, 290, 607.01, 850, 85
See application file for complete search history.

(56) References Cited

U.S. PATENT DOCUMENTS 6,280,237 B1 * 8/2001 Saka ..... H01R 13/4361 439/271
6,638,098 B2 * 10/2003 Yamaoka ..... H01R 13/639 439/489
6,749,455 B2 * 6/2004 Nishide ..... H01R 13/6272 439/188
7,481,685 B2 * 1/2009 Fukaya ..... H01R 13/187 439/595
9,515,403 B2 * 12/2016 Hirakawa ..... H01R 13/187
10,177,489 B1 * 1/2019 Aoshima ..... H01R 13/631
10,910,752 B2 * 2/2021 Kimura ..... H01R 13/26
2002/0004338 A1 * 1/2002 Cordeiro ..... H01R 13/432 439/625
2003/0060090 A1 * 3/2003 Allgood ..... H01R 11/289 439/845
2014/0227915 A1 * 8/2014 Glick ..... H01R 13/113 439/856
2021/0126390 A1 * 4/2021 Aizawa ..... H01H 1/06

FOREIGN PATENT DOCUMENTS

JP S53-47585 U 4/1978
JP H04-58981 U 5/1992
JP 2011-238558 A 11/2011
JP 2014-32867 A 2/2014

* cited by examiner

FEMALE TERMINAL

BACKGROUND

The present disclosure relates to a female terminal and, particularly, to a female terminal capable of conductive connection to a male terminal with a large contact pressure.

Conventionally, a female terminal with a box-shaped case including an opening in a side edge part and a pair of deflectable and deformable connecting portions projecting into the case, for example, described in Japanese Unexamined Patent Publication No. 2011-238558 is known as a female terminal to be used in an electric system of an automotive vehicle or the like. As shown in FIG. 8 of Japanese Unexamined Patent Publication No. 2011-238558, this female terminal is configured such that a male terminal and the connecting portions of the female terminal are electrically connected with a large contact pressure by mounting a separate spring member for applying a biasing force in an approaching direction to the pair of connecting portions after the male terminal is inserted into the case through the opening.

SUMMARY

However, in such a female terminal having a conventional structure, since the separate spring member needs to be mounted after the male terminal is inserted into the case through the opening, a working process increases and workability may be deteriorated. Accordingly, it is, for example, considered to apply a large biasing force in the approaching direction to the pair of connecting portions in advance. However, in this case, an insertion force when the male terminal is inserted into between the pair of connecting portions of the case through the opening increases, wherefore insertion may become difficult or the case of the female terminal and the male terminal may be damaged during insertion.

An exemplary aspect of the disclosure provides a female terminal having a novel structure and capable of reducing an insertion force during the insertion of a male terminal and facilitating an assembling operation of the male and female terminals while ensuring a large contact pressure between the male and female terminals.

The present disclosure is directed to a female terminal with a female terminal fitting including a connector to be conductively connected to a male terminal, a facing member held on the female terminal fitting, the facing member being arranged to face the connector across a male terminal insertion gap into which the male terminal is inserted, a spring held on the female terminal fitting, the spring biasing at least one of the facing member and the connector toward the other, and an approach displacement restricting device that maintains the male terminal insertion gap by restricting a displacement in an approaching direction between the facing member and the connector, wherein the male terminal is press-fit into the male terminal insertion gap to be disposed between the connector and the facing member by allowing a displacement in a separating direction between the connector and the facing member against a biasing force of the spring, the female terminal further comprises a case assembled with the female terminal fitting and including an accommodation space, the spring is held on the female terminal fitting by being accommodated in the accommodation space of the case, and the approach displacement restricting device includes an engaging projection provided on at least one of the facing member and the connector biased toward the other by the spring and an engaging window penetrating through a wall of the case, and the displacement in the approaching direction between the facing member and the connector is restricted by an engagement of the engaging projection with the engaging window.

According to the present disclosure, it is possible to pressingly hold a male terminal on a connector of a female terminal with a high contact pressure. In addition, it is possible to realize a high contact pressure between the male and female terminals by excellent workability and advantageously reduce an insertion force in an initial stage of insertion of the male terminal.

DETAILED DESCRIPTION OF EMBODIMENTS

Figure 1:
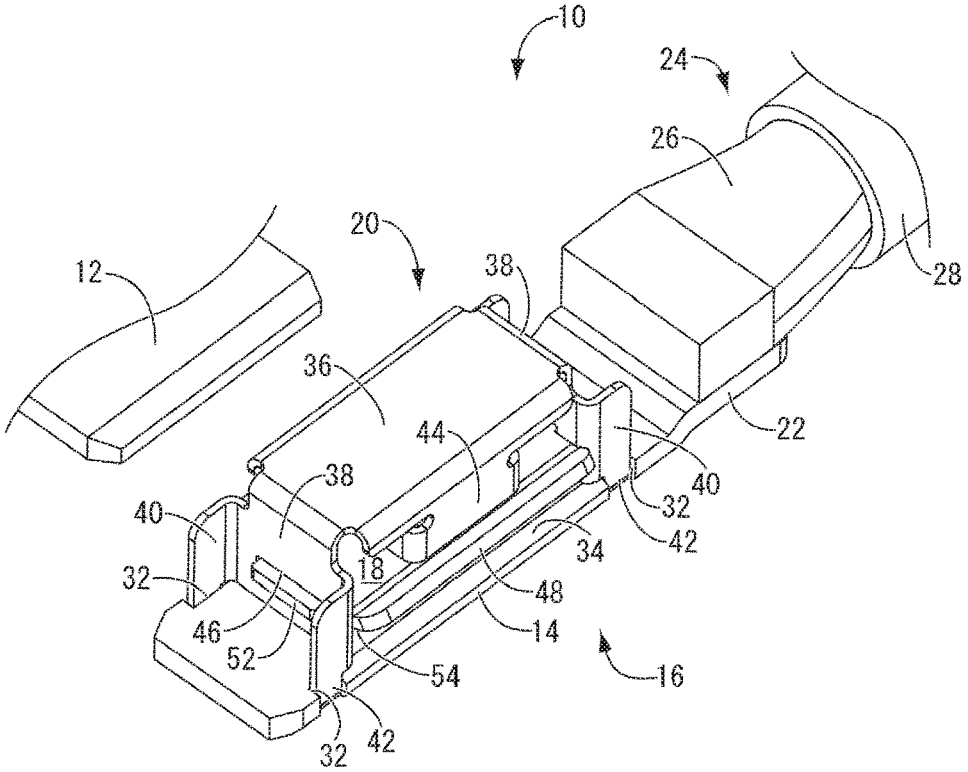
FIG. 1 is an overall perspective view showing a female terminal as a first embodiment of the present disclosure.

First, embodiments of the present disclosure are listed and described.

A first aspect of the present disclosure is directed to a female terminal with a female terminal fitting including a connecting portion to be conductively connected to a male terminal, a facing member held on the female terminal fitting, the facing member being arranged to face the connecting portion across a male terminal insertion gap into which the male terminal is inserted, a biasing means held on the female terminal fitting, the biasing means biasing at least one of the facing member and the connecting portion toward the other, and an approach displacement restricting means for maintaining the male terminal insertion gap by restricting a displacement in an approaching direction between the facing member and the connecting portion, wherein the male terminal is press-fit into the male terminal insertion gap to be disposed between the connecting portion and the facing member by allowing a displacement in a separating direction between the connecting portion and the facing member against a biasing force of the biasing means, the female terminal further comprises a case assembled with the female terminal fitting and including an accommodation space, the biasing means is held on the female terminal fitting by being accommodated in the accommodation space of the case, and the approach displacement restricting means includes an engaging projection provided on at least one of the facing member and the connecting portion biased toward the other by the biasing means and an engaging window penetrating through a wall portion of the case, and the displacement in the approaching direction between the facing member and the connecting portion is restricted by the engagement of the engaging projection with the engaging window.

According to this aspect, at least one of the facing member and the connecting portion arranged to face each other across the male terminal insertion gap into which the male terminal is inserted is biased toward the other by the biasing means. In this way, the male terminal inserted and arranged in the male terminal insertion gap is pressed against the connecting portion of the female terminal fitting by the biasing force of the biasing means, and the male terminal can be pressed against and held on the connecting portion of the female terminal with a high contact pressure. Further, the facing member and the biasing means are held on the female terminal fitting provided with the connecting portion. A separate spring member or the like needs not be mounted to sandwich a conductive connection part after the male terminal is conductively connected to the female terminal as before. Therefore, a working process can be simplified and a high contact pressure between the male and female terminals can be realized by excellent workability.

In addition, the facing member and the connecting portion are held at positions (in states) across the male terminal insertion gap against the biasing force of the biasing means. In this way, in inserting the male terminal toward the connecting portion of the female terminal, it is sufficient only to insert the male terminal into the male terminal insertion gap formed with the biasing force of the biasing means dispersed to the approach displacement restricting means in advance and an insertion force in an initial stage of insertion of the male terminal can be advantageously reduced. Further, the displacement in the separating direction between the connecting portion and the facing member is allowed against the biasing force of the biasing means. Therefore, by press-fitting the male terminal into the male terminal insertion gap, the displacement in the separating direction between the connecting portion and the facing member is allowed against the biasing force and the male terminal can be inserted into between the connecting portion and the facing member and disposed and held between the both in a press-contact state. At this time, via at least one of the facing member and the connecting portion, the biasing force of the biasing means can be applied to the male terminal and the other without being dispersed to the approach displacement restricting means, and the male terminal can be pressed against the connecting portion of the female terminal with a large contact pressure. According to this aspect, the biasing member is held on the female terminal fitting by using the case assembled with the female terminal fitting and including the accommodation space and accommodating the biasing member into the accommodation space of the case. In this way, the biasing member can be integrally held on the female terminal fitting by a small number of components. In addition, since the approach displacement restricting means is also realized by engaging the engaging window penetrating through the wall portion of the case and the engaging projection provided on at least one of the facing member and the connecting portion, various mechanism can be efficiently realized by a smaller number of components. Particularly, since the contact pressure of the male terminal with the connecting portion of the female terminal is improved, utilizing the case assembled with the female terminal fitting and including the accommodation space and the biasing member accommodated and held in the case, the contact pressure can be increased without being accompanied by shape changes and the like of the connecting portions of the male and female terminals and the female terminal of the present disclosure can be realized with good versatility while the existing male terminal and the existing female terminal fitting are utilized.

Note that any of known members for applying a biasing force such as spring members including coil springs, leaf springs and disc springs and elastic bodies including rubber elastic bodies can be employed as the biasing means.

A second aspect of the present disclosure is such that, in the female terminal according to the first aspect, the facing member includes a pressing member held on the female terminal fitting, the pressing member is arranged to face the connecting portion of the female terminal fitting across the male terminal insertion gap and biased toward the connecting portion by the biasing means, and the pressing member is displaceable in a direction away from the connecting portion against the biasing force.

According to this aspect, the facing member arranged to face the connecting portion across the male terminal insertion gap into which the male terminal is inserted is constituted by the pressing member. In this way, the biasing force of the biasing means can be stably applied to the male terminal press-fit into the male terminal insertion gap via the pressing member. Further, since the biasing means and the pressing member can be handled as a series of components, the pressing member and the biasing means can be assembled with the female terminal fitting provided with the connecting portion after being assembled into one member. Alternatively, the pressing member and the biasing means can be configured as an integral component. In this way, the assemblability of the female terminal can be improved.

A third aspect of the present disclosure is such that, in the female terminal according to the second aspect, the pressing member and the biasing means are held on the female terminal fitting by being accommodated in the accommodation space of the case, and the approach displacement restricting means includes the engaging projection provided on the pressing member and the engaging window penetrating through the wall portion of the case and extending a predetermined length in a facing direction of the pressing member and the connecting portion, and an end edge part of the engaging window on the side of the connecting portion is set at a position separated from the connecting portion across the male terminal insertion gap, whereas the engaging projection of the pressing member is biased and engaged with the end edge part.

According to this aspect, the pressing member and the biasing means are held on the female terminal fitting by using the case assembled with the female terminal fitting and including the accommodation space and accommodating the pressing member and the biasing means into the accommodation space of the case. In this way, the pressing member and the biasing means can be integrally held on the female terminal fitting by a small number of components. In addition, the approach displacement restricting means is also realized by engaging the engaging window penetrating through the wall portion of the case and extending the predetermined length in the facing direction of the pressing member and the connecting portion and the engaging projection provided on the pressing member. Thus, various mechanisms can be efficiently realized by a smaller number of components.

Particularly, since the contact pressure of the male terminal with the connecting portion of the female terminal is improved, utilizing the case assembled with the female terminal fitting and including the accommodation space and the pressing member and the biasing means accommodated and arranged in the case, the contact pressure can be increased without being accompanied by shape changes and the like of the connecting portions of the male and female terminals, and the female terminal of the present disclosure can be realized with good versatility while the existing male terminal and the existing female terminal fitting are utilized.

A fourth aspect of the present disclosure is such that, in the female terminal according to the third aspect, the female terminal fitting has a rectangular flat plate shape, a wire connecting portion is provided on one side in a longitudinal direction of the female terminal fitting and a part of the female terminal fitting closer to the other longitudinal side than the wire connecting portion serves as the connecting portion, the case is assembled on a surface of the connecting portion of the female terminal fitting, the case includes the wall portion facing the connecting portion via the accommodation space and the flat plate-like pressing member accommodated and arranged in the accommodation space is positioned and held above and in parallel to the connecting portion across the male terminal insertion gap, the biasing means is accommodated and arranged in a compressed state between the wall portion of the case and the pressing member and the engaging projection of the pressing member is biased toward the end edge part of the engaging window on the side of the connecting portion, and the male terminal insertion gap communicates with outside via a male terminal insertion opening provided in the case.

According to this aspect, the case is assembled on the surface of the connecting portion provided on the female terminal fitting in the form of a rectangular flat plate. The flat plate-like pressing member is positioned and held in the case while being arranged to face the connecting portion in parallel to each other across the male terminal insertion gap. The pressing member is biased toward the connecting portion by the biasing means disposed in a compressed state between the pressing member and the wall portion of the case facing the connecting portion. In this way, the male terminal can be reliably pressed by the biasing force of the biasing means in the male terminal insertion gap formed between the flat plate-like pressing member and the flat plate-like connecting portion. Therefore, particularly when the male terminal has a flat plate shape, the male terminal can be stably pressed against the female terminal fitting with a wider contact area, the contact pressure of the male and female terminals can be reliably improved and the male and female terminals can be conductively connected with even less resistance.

A fifth aspect of the present disclosure is such that, in the female terminal according to the fourth aspect, the male terminal insertion opening of the case is open in a direction orthogonal to the longitudinal direction of the female terminal fitting.

According to this aspect, the male terminal insertion opening provided in the case is open in the direction orthogonal to the longitudinal direction of the female terminal fitting. In this way, the male terminal can be assembled from a lateral side of the female terminal, and a sufficient contact area can be secured while an insertion distance of the male terminal into the female terminal is shortened. Further, such as when the male terminal projects in a vertical direction, a height reduction of a connection area of the male and female terminals can be advantageously realized.

A sixth aspect of the present disclosure is such that, in the female terminal according to the fourth or fifth aspect, an edge part of the pressing member projects outward from the male terminal insertion opening provided in the case and bent in the direction away from the connecting portion.

According to this embodiment, the edge part of the pressing member projects outward from the male terminal insertion opening provided in the case and bent upwardly away from the connecting portion. In this way, the edge part of the pressing member achieves a guiding function and the male terminal can be more smoothly inserted into the male terminal insertion opening and further into the male terminal insertion gap.

A seventh aspect of the present disclosure is such that, in the female terminal according to the third aspect, a wire connecting portion is provided on one longitudinal end edge part of the female terminal fitting and the connecting portion having a concave shape and open toward the other longitudinal side is provided on the other longitudinal end edge part of the female terminal fitting, the case is disposed on a side opposite to the wire connecting portion with respect to the connecting portion in the longitudinal direction and assembled with the female terminal fitting, the case includes the wall portion facing the connecting portion via the accommodation space, and the pressing member accommodated and arranged in the accommodation space is positioned and held across the male terminal insertion gap in the longitudinal direction with respect to the connecting portion, the biasing means is accommodated and arranged in a compressed state between the wall portion of the case and the pressing member and the engaging projection of the pressing member is biased toward the end edge part of the engaging window on the side of the connecting portion, and the male terminal insertion gap communicates with outside via a male terminal insertion opening located between the pressing member and the connecting portion in the longitudinal direction, provided in the case and open in a direction orthogonal to the longitudinal direction.

According to this aspect, the female terminal fitting is shaped such that the wire connecting portion is provided on the one longitudinal end edge part thereof and the concave connecting portion open toward the other longitudinal side is provided on the other longitudinal end edge part of the female terminal fitting. Further, the case is assembled on the side of the other longitudinal end edge part of the female terminal fitting, and the flat plate-like pressing member positioned and held in the case while being arranged to face the connecting portion across the male terminal insertion gap in the longitudinal direction is biased by the biasing means disposed in a compressed state between the pressing member and the wall portion of the case. In this way, the female terminal fitting and the pressing member and the biasing means in the case are successively disposed in an overlapping manner in the longitudinal direction of the female terminal fitting, i.e. in an extending direction of a wire from the female terminal fitting. Therefore, when the male terminal has a cylindrical pin shape, a stacking structure of the pressing member and the biasing means in a direction orthogonal to the extending direction of the wire can be avoided even if the male terminal has a large diameter, and a structure of the female terminal with a suppressed height can be advantageously provided.

Further, since the male terminal insertion opening is open in the direction orthogonal to the longitudinal direction of the female terminal fitting, the male terminal can be assembled from a lateral side of the female terminal and stable connection of the male and female terminals can be ensured by a high contact pressure while a height reduction of the female terminal is realized. Particularly, since the connecting portion is formed into a concave shape, the pin-shaped male terminal can be stably held while a contact area with the male terminal having the cylindrical pin shape is reliably secured.

An eighth aspect of the present disclosure is such that, in the female terminal according to the seventh aspect, the female terminal fitting is formed by bending a strip-like flat plate fitting and the wire connecting portion is formed by overlapping longitudinal end edge parts of the flat plate fitting, and the other longitudinal end edge part of the female terminal fitting is formed into a tubular shape in a side view and the connecting portion having the concave shape is formed by concavely recessing a wall portion defining an end surface on the other longitudinal side of the female terminal fitting.

According to this aspect, the female terminal fitting according to the seventh aspect can be easily formed by bending the strip-like flat plate fitting. The connecting portion is provided on a tip surface of the tubular end edge part, and current paths pass through both side walls of the tubular end edge part and are overlapped in the wire connecting portion. Therefore, a larger current can flow by increasing a cross-sectional area while the weight of the female terminal fitting is reduced and the strength of the female terminal fitting is ensured.

A ninth aspect of the present disclosure is such that, in the female terminal according to the first aspect, the connecting portion of the female terminal fitting is accommodated and arranged in the accommodation space of the case assembled with the female terminal fitting and the facing member includes the wall portion of the case, the connecting portion of the female terminal fitting is arranged to face the wall portion of the case across the male terminal insertion gap and biased toward the wall portion by the biasing means, and the connecting portion of the female terminal fitting is displaceable in a direction away from the wall portion of the case against the biasing force.

According to this aspect, the connecting portion of the female terminal fitting and the wall portion of the case constituting the facing member are arranged to face each other across the male terminal insertion gap. Out of the connecting portion and the wall portion of the case, the connecting portion of the female terminal fitting is biased toward the wall portion of the case by the biasing means. In this way, the connecting portion of the female terminal fitting is directly pressed against the male terminal press-fit and arranged in the male terminal insertion gap by the biasing force of the biasing means. Therefore, the male terminal can be pressed against and held on the connecting portion of the female terminal with a high contact pressure. Further, since the connecting portion of the female terminal is directly pressed against the male terminal by the biasing means, the connecting portion can better follow the male terminal when the male terminal is displaced, for example, due to vibration when a vehicle is driven. In this way, the connecting portion of the female terminal can be advantageously brought into contact with the male terminal with a wide area and the connection stability of the female terminal can be improved by advantageously avoiding the occurrence of one-side contact of the male terminal with the connecting portion of the female terminal and the like.

A tenth aspect of the present disclosure is such that, in the female terminal according to the ninth aspect, the female terminal fitting has a rectangular flat plate shape, a wire connecting portion is provided on one side in a longitudinal direction of the female terminal fitting and a part of the female terminal fitting closer to the other longitudinal side than the wire connecting portion serves as the connecting portion, one surface of the connecting portion of the female terminal fitting accommodated in the accommodation space of the case faces the wall portion of the case across a gap and the other surface of the connecting portion faces another wall portion of the case across a gap, the biasing means is accommodated and arranged in a compressed state between the connecting portion and the other wall portion of the case and the connecting portion and the wall portion of the case are arranged to face each other across the male terminal insertion gap, and the connecting portion is biased toward the wall portion of the case by the biasing means.

According to this aspect, the one surface of the connecting portion of the female terminal fitting accommodated in the accommodation space of the case faces the wall portion of the case across the gap and the other surface of the connecting portion faces the other wall portion of the case across the gap. The connecting portion is biased toward the wall portion of the case by the biasing means disposed in a compressed state between the connecting portion and the other wall portion of the case. In this way, the male terminal can be reliably pressed by the biasing force of the biasing means in the male terminal insertion gap formed between the connecting portion and the wall portion of the case. Therefore, particularly when the male terminal has a flat plate shape, the male terminal can be stably pressed against the female terminal fitting with a wider contact area, the contact pressure of the male and female terminals can be reliably improved and the male and female terminals can be conductively connected with even less resistance.

Further, since the connecting portion of the female terminal fitting is accommodated and arranged in the accommodation space of the single case and the biasing means is compressed and the facing member is formed, utilizing a pair of the wall portions of the case facing each other on both sides of the connecting portion, the female terminal of the present disclosure can be compactly formed.

An eleventh aspect of the present disclosure is such that, in the female terminal according to any one of the first to tenth aspects, the biasing means includes a coil spring.

According to this aspect, since the biasing means includes the coil spring, a large deflection amount of the biasing means can be secured. Therefore, a spring constant can be reduced while a compact configuration is realized by disposing the biasing means in the limited accommodation space of the case, and a contact pressure variation between the male and female terminals can be suppressed to be small even if dimensional errors of components and the like occur.

Hereinafter, embodiments of the present disclosure are described with reference to the drawings.

First, FIGS. 1 to 5 show a female terminal 10 as a first embodiment of the present disclosure. The female terminal 10 includes a female terminal fitting 16 having a connecting portion 14 (connector) to be conductively connected to a tab-shaped male terminal 12 substantially in the form of a rectangular flat plate. Further, the female terminal 10 includes a case 20 having an accommodation space 18 and to be assembled with the female terminal fitting 16. Note that, in the following description, an upper side means an upper side in FIGS. 1, 4 and 5, a lower side means a lower side in FIGS. 1, 4 and 5, a front side means a left side in FIGS. 2 to 4, a rear side means a right side in FIGS. 2 to 4, a longitudinal direction means a lateral direction in FIGS. 2 to 4 and a width direction means a vertical direction in FIGS. 2 and 3.

Figure 4:
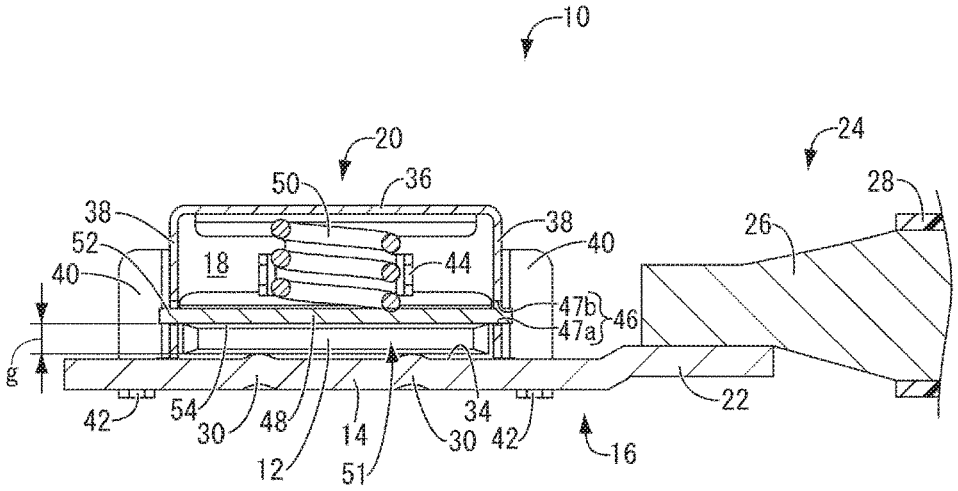
FIG. 4 is a section along IV-IV in FIG. 2.

As shown in FIGS. 1 and 4, the female terminal fitting 16 is substantially in the form of a rectangular flat plate extending in the longitudinal direction. A wire connecting portion 22 is provided in a flat part on one longitudinal side (right side in FIG. 4) of the female terminal fitting 16, whereas a flat part located somewhat lower (lower side in FIG. 4) than the wire connecting portion 22 and closer to the other longitudinal side (left side in FIG. 4) than the wire connecting portion 22 serves as the connecting portion 14. The female terminal fitting 16 is conductive and formed using any one of various metal materials, which can be press-worked and stamped, such as brass, copper, copper alloy, aluminum and aluminum alloy. In the wire connecting portion 22, a core 26 of a wire 24 is conductively connected to the female terminal fitting 16. More particularly, the wire 24 is structured such that the core 26 serving as a conductor and formed by bundling a plurality of metal wires made of copper, aluminum or another metal is covered by an insulation coating 28 having electrical insulation and made of ethylene-based resin or styrene-based resin. The core 26 exposed by stripping the insulation coating 28 on an end of the wire 24 is fixed to the wire connecting portion 22 of the female terminal fitting 16 using a known technique such as resistance welding, whereby the core 26 of the wire 24 is conductively connected to the female terminal fitting 16.

Figure 2:
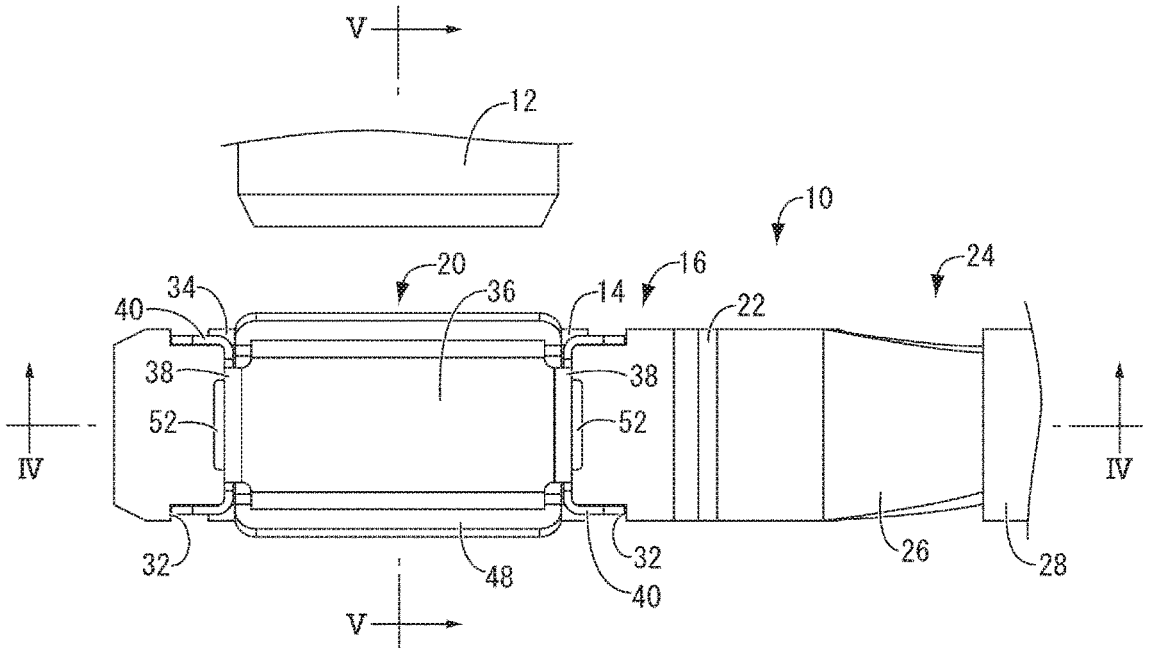
FIG. 2 is a plan view of the female terminal shown in FIG. 1.
Figure 3:
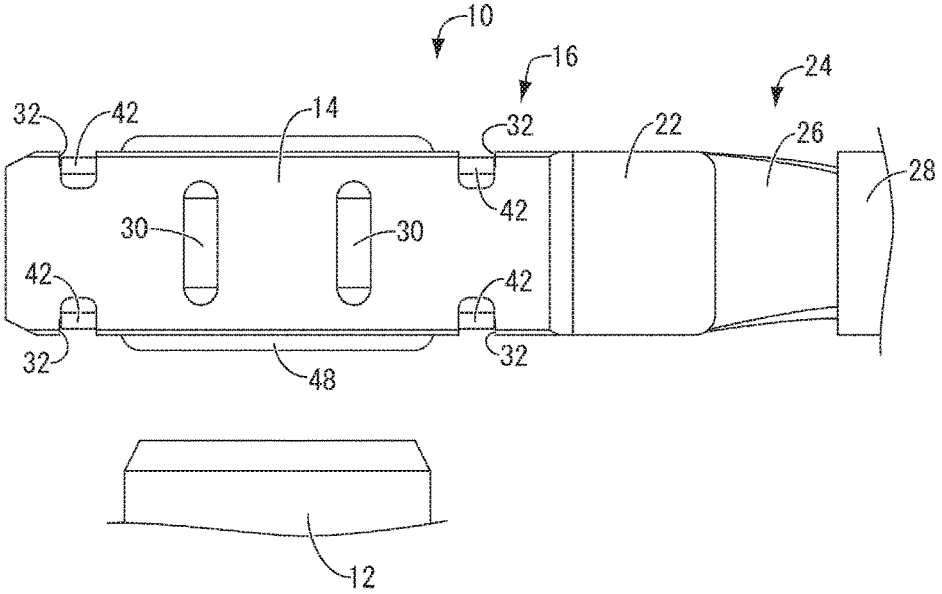
FIG. 3 is a bottom view of the female terminal shown in FIG. 1.

On the other hand, as shown in FIGS. 3 and 4, embossed portions 30 extending in the width direction (vertical direction in FIG. 3) and projecting upward in a plate thickness direction (vertical direction in FIG. 4) are formed at two positions separated in the longitudinal direction in a central part of the connecting portion 14 in the longitudinal direction (lateral direction in FIGS. 3 and 4). In addition, as shown in FIGS. 1 to 3, cutout portions 32 are provided at two positions separated in the longitudinal direction of the connecting portion 14 on each of both widthwise side edge parts of the connecting portion 14. Each cutout portion 32 has a substantially rectangular shape in a plan view and is open outward in the plate thickness direction and the width direction (vertical direction in FIGS. 2 and 3) of the connecting portion 14.

The case 20 is assembled on a surface 34 of the connecting portion 14 of the female terminal fitting 16 thus configured (see, for example, FIG. 4). The case 20 is formed using any one of various metal materials, which can be press-worked and stamped, such as brass, copper, copper alloy, aluminum, aluminum alloy and stainless steel. More particularly, the case 20 includes a wall portion 36 substantially in the form of a rectangular flat plate facing the connecting portion 14 via an accommodation space 18 in a state assembled with the connecting portion 14 of the female terminal fitting 16. Further, the case 20 includes a pair of wall portions 38, 38 substantially in the form of rectangular flat plates extending downward from both side edge parts in the longitudinal direction of the wall portion 36, and the accommodation space 18 is configured by the wall portion 36 and the pair of wall portions 38, 38. Furthermore, the case 20 includes a pair of leg portions 40 substantially in the form of flat plates projecting outward in the longitudinal direction (lateral direction in FIG. 2) of the wall portion 36 after projecting outward in the width direction from both side edge parts in the width direction (vertical direction in FIG. 2) of the respective wall portions 38. Crimping projections 42 substantially in the form of rectangular flat plates projecting downward are provided on lower end parts of the respective leg portions 40. In addition, coil spring holding frames 44 extending downward and having a substantially concave shape open inward in the width direction of the wall portion 36 on extending end parts are provided in central parts of the both side edge parts in the width direction of the wall portion 36. Further, engaging windows 46 are provided to penetrate through the pair of wall portions 38, 38 arranged to face each other in the longitudinal direction of the wall portion 36 at the same positions facing each other below the coil spring holding frames 44. The respective engaging windows 46 have a substantially laterally long rectangular cross-sectional shape and constitute an approach displacement restricting means/device.

A pressing member 48 constituting a facing member and a coil spring 50 constituting a biasing means are accommodated and arranged in the accommodation space 18 of the case 20 thus configured. The case 20 in which the pressing member 48 and the coil spring 50 are accommodated and arranged in the accommodation space 18 is held on the connecting portion 14 of the female terminal fitting 16 (see, for example, FIG. 4). More particularly, the pressing member 48 has a substantially rectangular flat plate shape and formed using any one of various metal materials, which can be press-worked and stamped, such as brass, copper, copper alloy, aluminum, aluminum alloy and stainless steel. Engaging projections 52 substantially in the form of rectangular flat plates projecting outward in the longitudinal direction and constituting the approach displacement restricting means to be described later are provided on both side edges in the longitudinal direction (lateral direction in FIG. 4) of the pressing member 48. Both end edge parts 53, 53 in the width direction (lateral direction in FIG. 5) of the pressing member 48 are bent obliquely upwardly. With the coil spring 50 accommodated and held in the coil spring holding frames 44 of the case 20, the pressing member 48 is inserted into the accommodation space 18 while pushing extending end parts of the pair of wall portions 38, 38 of the case 20 wider apart. Specifically, by engaging the engaging projections 52 of the pressing member 48 with the engaging windows 46 of the case 20, the coil spring 50 is accommodated and arranged in a compressed state between the wall portion 36 of the case 20 and the pressing member 48. In this way, the pressing member 48 is biased toward the connecting portion 14 and the engaging projections 52 of the pressing member 48 are biased toward end edge parts 47*a* of the engaging windows 46 on the side of the connecting portion 14. Subsequently, the case 20 having the pressing member 48 and the coil spring 50 accommodated and arranged in this way is assembled on the surface 34 of the connecting portion 14 of the female terminal fitting 16. Specifically, by bending and crimping the crimping projections 42 of the case 20 inwardly in the width direction after the crimping projections 42 are inserted into the cutout portions 32 of the connecting portion 14, the case 20 is fixed with the leg portions 40 of the case 20 placed on the surface 34 of the connecting portion 14 and the pressing member 48 and the coil spring 50 accommodated in the case 20 are indirectly held on the female terminal fitting 16. As just described, in this embodiment, the coil spring 50 constituting the biasing means and the pressing member 48 can be assembled with the female terminal fitting 16 provided with the connecting portion 14 after being assembled as a series of components in advance, and assemblability can be improved.

Figure 5:
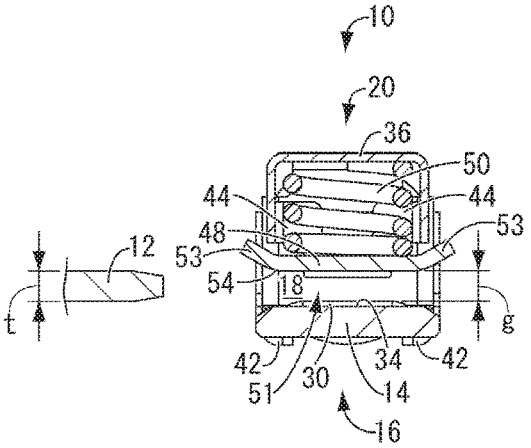
FIG. 5 is a section along V-V in FIG. 2.
Figure 6:
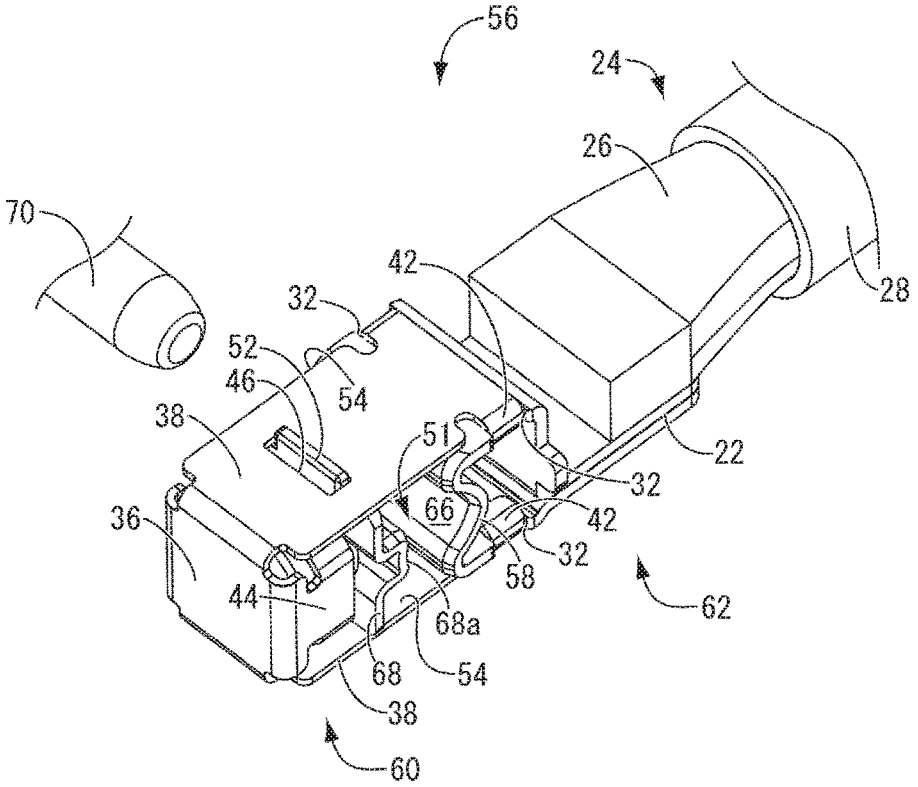
FIG. 6 is an overall perspective view showing a female terminal as a second embodiment of the present disclosure.
Figure 7:
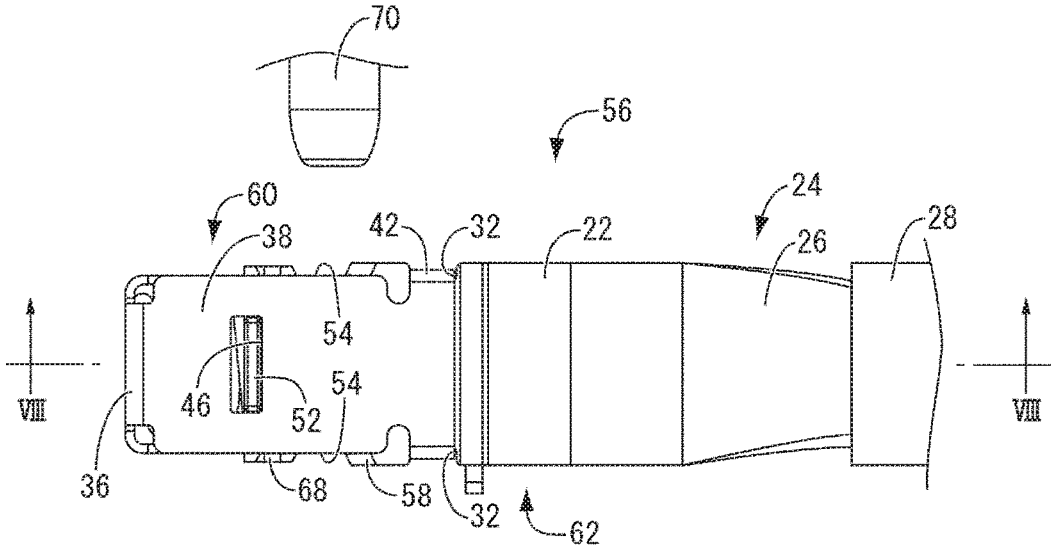
FIG. 7 is a plan view of the female terminal shown in FIG. 6.
Figure 8:
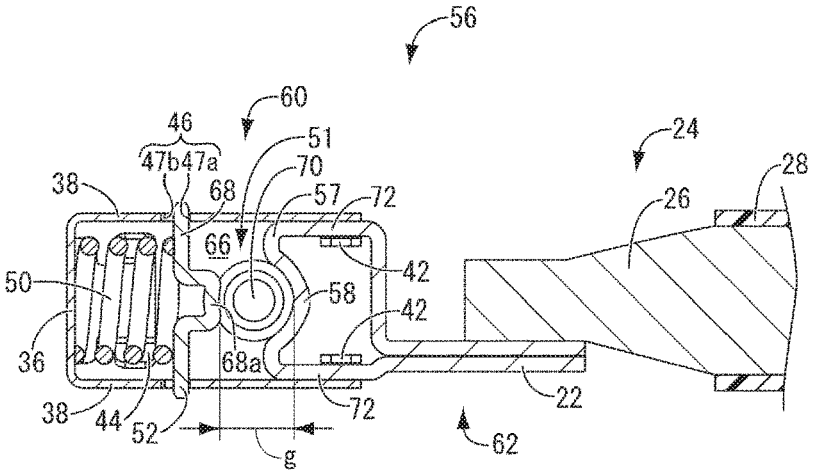
FIG. 8 is a section along VIII-VIII in FIG. 7.

In this way, for example, as shown in FIG. 4, the flat plate-like pressing member 48 accommodated and arranged in the accommodation space 18 is positioned and held above and in parallel to the connecting portion 14 across a male terminal insertion gap 51 and is arranged to face the connecting portion 14. Note that since the embossed portions 30, 30 project on the connecting portion 14 in this embodiment, a gap dimension g (see FIG. 5) of the male terminal insertion gap 51 is specified by a dimension between projecting end surfaces of the embossed portions 30 and the lower surface of the pressing member 48 facing each other. The pressing member 48 is indirectly held on the female terminal fitting 16 and the male terminal insertion gap 51 communicates with outside via a male terminal insertion opening 54 provided in the case 20. Specifically, the male terminal insertion opening 54 of the case 20 is open in directions orthogonal to the longitudinal direction of the female terminal fitting 16 (toward an oblique right-lower side and an oblique left-upper side in FIG. 1). Thus, the male terminal 12 can be assembled from a lateral side of the female terminal 10 (vertical direction in FIG. 2), and a sufficient contact area can be secured while an insertion distance of the male terminal 12 into the female terminal 10 is shortened. Further, such as when the male terminal 12 projects in the vertical direction, a connection area of the female terminal 10 and the male terminal 12 can be advantageously reduced in height. Furthermore, for example, as shown in FIG. 5, the both end edge parts 53, 53 in the width direction (lateral direction in FIG. 5) of the pressing member 48 project outward from the male terminal insertion opening 54 provided in the case 20 and are bent in directions away from the connecting portion 14 of the female terminal fitting 16 (obliquely upwardly in this embodiment). Since bent parts achieve a function of guiding the male terminal 12, the male terminal 12 can be more smoothly inserted into the male terminal insertion gap 51 via the male terminal insertion opening 54.

In addition, the approach displacement restricting means is configured to include the engaging projections 52 provided on the pressing member 48 and the engaging windows 46 penetrating through the wall portions 38 of the case 20. The approach displacement restricting means is also indirectly held on the female terminal fitting 16. Here, the engaging windows 46 extend a predetermined length in a facing direction (vertical direction in FIGS. 4 and 5) of the pressing member 48 and the connecting portion 14. When the male terminal 12 having a plate thickness t (t>g) larger than the gap dimension g of the male terminal insertion gap 51 is press-fit and inserted into the male terminal insertion gap 51, the pressing member 48 is displaceable in a direction away from the connecting portion 14 against a biasing force of the coil spring 50. Specifically, the male terminal 12 is press-fit into the male terminal insertion gap 51 and disposed between the connecting portion 14 and the pressing member 48. Further, the end edge parts 47*a* of the engaging windows 46 on the side of the connecting portion 14 are set to hold the pressing member 48 at a position separated from the projecting end surfaces of the embossed portions 30 by the gap dimension g of the male terminal insertion gap 51. The engaging projections 52 provided on the pressing member 48 are engaged with the end edge parts 47*a* while being biased toward the connecting portion 14 by the coil spring 50. Specifically, a displacement in an approaching direction between the pressing member 48 and the connecting portion 14 is restricted to maintain the male terminal insertion gap 51 by the engaging projections 52 and the engaging windows 46 constituting the approach displacement restricting means. Further, the detachment of the male terminal 12 and the like are prevented by suppressing an excessive displacement between the female terminal 10 and the male terminal 12 due to vibration or the like by the contact of the engaging projections 52 of the pressing member 48 with end edge parts 47*b* of the engaging windows 46 on a side distant from the connecting portion 14. Note that since the biasing means is configured using the coil spring 50 in this embodiment, a large deflection amount can be secured. Therefore, the coil spring 50 having a small spring constant can be compactly disposed in the limited accommodation space of the case 20 and a contact pressure variation between the female terminal 10 and the male terminal 12 can be suppressed to be small even if the gap dimension g of the male terminal insertion gap 51, the plate thickness t of the male terminal and the like vary.

According to the female terminal 10 of this embodiment thus configured, the pressing member 48 is positioned and held above and in parallel to the connecting portion 14 across the male terminal insertion gap 51. The pressing member 48 is biased toward the connecting portion 14 by the coil spring 50. In this way, the male terminal 12 inserted and arranged in the male terminal insertion gap 51 is pressed against the connecting portion 14 of the female terminal fitting 16 by the biasing force of the coil spring 50. As a result, the male terminal 12 can be pressed against and held on the connecting portion 14 of the female terminal 10 with a high contact pressure. Further, the pressing member 48 and the coil spring 50 are assembled with the female terminal fitting 16 in advance. Since a separate spring member or the like needs not be mounted after the conductive connection of the male terminal 12 as before, a working process can be simplified and a high contact pressure between the male terminal 12 and the female terminal 10 can be realized by excellent workability.

Further, the pressing member 48 is held at the position across the male terminal insertion gap 51 by the engaging projections 52 and the engaging windows 46 constituting the approach displacement restricting means. A displacement in the direction away from the connecting portion 14 is possible against the biasing force of the coil spring 50. In this way, the male terminal 12 and the female terminal 10 can be conductively connected with a high contact pressure only by inserting the male terminal 12 into the male terminal insertion gap 51 of the female terminal 10. Further, the gap dimension g of the male terminal insertion gap 51 is set slightly smaller than the plate thickness t of the male terminal 12. Thus, the amount of displacement of the pressing member 48 in the direction away from the connecting portion 14 is small and the amount of work is small when the male terminal 12 is inserted into the male terminal insertion gap 51, and an insertion force at the time of inserting the male terminal 12 into the male terminal insertion gap 51 can be advantageously reduced.

In addition, the pressing member 48 and the coil spring 50 constituting the biasing means are accommodated and arranged in the accommodation space 18 of the case 20. By assembling this case 20 with the female terminal fitting 16, the pressing member 48 and the coil spring 50 can be easily held on the female terminal fitting 16. Thus, it can be easily realized to integrally hold the pressing member 48 and the coil spring 50 on the female terminal fitting 16 by using the case 20. Further, the approach distance restricting means is constituted by the engaging windows 46 penetrating through the wall portions 38 of the case 20 and the engaging projections 52 provided on the pressing member 48. The approach distance restricting means can be efficiently configured by using the case 20. Further, by assembling the case 20 with the female terminal fitting 16, the pressing member 48 and the coil spring 50 accommodated and held in the case 20 and the approach distance restricting means (engaging windows 46 and engaging projections 52) are configured. The insertion force of the male terminal 12 into the male terminal insertion gap 51 of the female terminal 10 is reduced and the contact pressure is improved, utilizing the pressing member 48, the coil spring 50 and the approach distance restricting means. Thus, it is possible to reduce the insertion force and improve the contact pressure without being accompanied by shape changes and the like of the connecting portion 14 of the female terminal 10 and the male terminal 12. The female terminal 10 of the present disclosure can be realized with good versatility while the existing male terminal 12 and the existing female terminal fitting are utilized.

Next, a female terminal 56 as a second embodiment of the present disclosure is described in detail using FIGS. 6 to 10. Members and parts structured as in the above embodiment are denoted by the same reference signs as in the above embodiment in figures and not described in detail. This embodiment differs from the first embodiment in that a case 60 is disposed on a side opposite to a wire connecting portion 22 with respect to a connecting portion 58 in a longitudinal direction of the female terminal 56 and assembled with a female terminal fitting 62. More particularly, the female terminal fitting 62 is formed by bending an unillustrated strip-like flat plate fitting. The wire connecting portion 22 is provided in a flat part formed by overlapping longitudinal end edge parts of the flat plate fitting on one longitudinal side (right side in FIG. 8) of the female terminal fitting 62. On the other hand, a central part of the flat plate fitting is formed into a tubular body in a side view on the other longitudinal side (left side in FIG. 8). A connecting portion 58 shaped by concavely recessing a wall portion 57 defining an end surface is configured on the other longitudinal end edge part of the female terminal fitting 62. The concave connecting portion 58 is open toward the other longitudinal side of the female terminal fitting 62.

Figure 9:
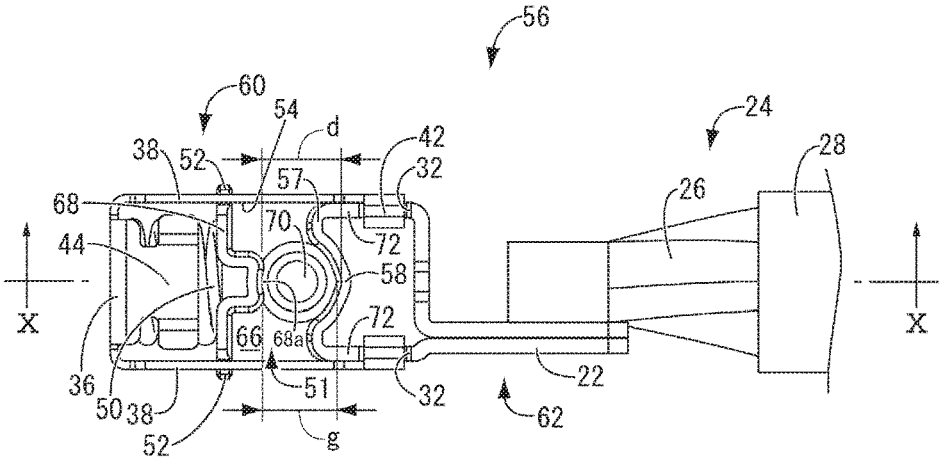
FIG. 9 is a front view of the female terminal shown in FIG. 6.
Figure 10:
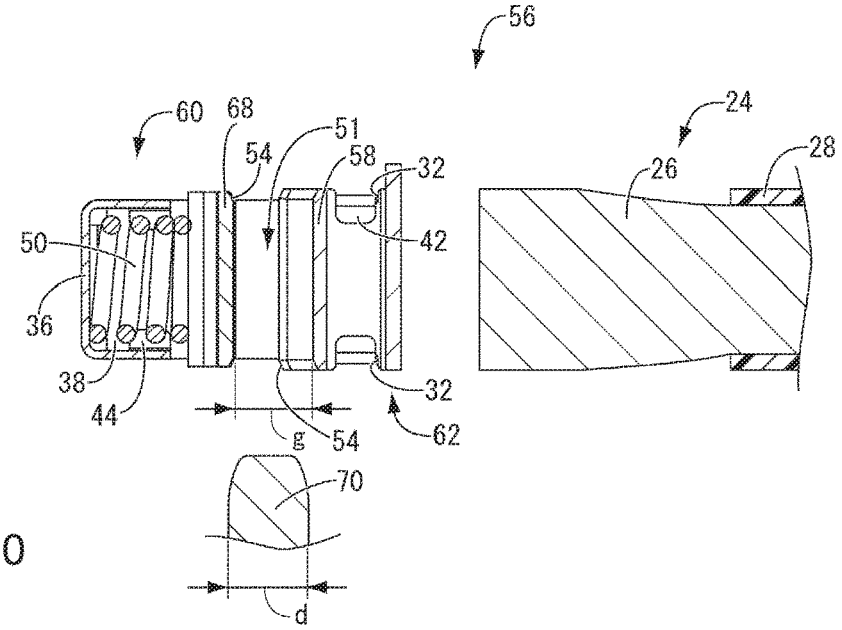
FIG. 10 is a section along X-X in FIG. 9.

Cutout portions 32 to which crimping projections 42 to be described later are crimped and fixed are formed in wall portions 72, 72 extending from the connecting portion 58 toward the wire connecting portion 22. The case 60 is disposed on the side opposite to the wire connecting portion 22 with respect to the connecting portion 58 in the longitudinal direction of the female terminal 56 and assembled with the connecting portion 58 of the female terminal fitting 62. The case 60 includes a wall portion 36 having a substantially rectangular flat plate shape. The wall portion 36 faces the connecting portion 58 via an accommodation space 66 with the case 60 assembled with the connecting portion 58 of the female terminal fitting 62. The case 60 includes a pair of wall portions 38 substantially in the form of rectangular flat plates projecting from both end edge parts in a width direction (vertical direction in FIG. 8) of the wall portion 36 toward one longitudinal side (right side in FIG. 8) of the female terminal 56. The crimping projections 42 projecting outward are provided on widthwise end edge parts of projecting tip parts of the respective wall portions 38. Further, such a pressing member 68 that a central part of a flat plate member is bent to project toward the connecting portion 58 is accommodated and arranged in the accommodation space 66 of the case 60, and a coil spring 50 is accommodated and arranged between the pressing member 68 and the wall portion 36 of the case 60. With engaging projections 52 provided on the pressing member 68 engaged with engaging windows 46 of the case 60, the crimping projections 42 of the case 60 are crimped to the cutout portions 32 of the connecting portion 58. In this way, the case 60 is fixed to the connecting portion 58 and a convex central part 68*a* of the pressing member 68 is positioned and held with respect to the connecting portion 58 across a male terminal insertion gap 51 in the longitudinal direction of the female terminal 56. The coil spring 50 between the wall portion 36 of the case 60 and the pressing member 68 is accommodated and arranged in a compressed state. Therefore, the engaging projections 52 provided on the pressing member 68 are biased toward end edge parts 47*a* of the engaging windows 46 provided in the case 60 on the side of the connecting portion 58. A male terminal insertion opening 54 wide open in a direction (vertical direction in FIGS. 7 and 10) orthogonal to the longitudinal direction of the female terminal 56 is provided in a side surface of the case 60 located between the pressing member 68 and the connecting portion 58 in the longitudinal direction of the female terminal 56. The male terminal insertion gap 51 communicates with outside via the male terminal insertion opening 54. A pin-like male terminal 70 is inserted into and held in the male terminal insertion gap 51, thereby being conductively connected to the connecting portion 58 of the female terminal fitting 62. In this embodiment, a radius of curvature of the concave connecting portion 58 is slightly larger than that of the male terminal 70. Therefore, the pin-like male terminal 70 can be accommodated and held in the concave connecting portion 58 with a wide contact area, and connection with less resistance between the female terminal 56 and the male terminal 70 can be realized. Note that the pressing member 68 is formed into a convex shape to form a gap for accommodating a rib for preventing human contact provided on the side of the male terminal 70 having a high voltage in a length direction (vertical direction in FIG. 8). Further, in this embodiment, a maximum gap dimension g between the central part 68*a* of the pressing member 68 and the connecting portion 58 constituting the male terminal insertion gap 51 is slightly smaller than a maximum outer diameter d of the male terminal 70 ($g<d$) as shown in FIG. 9.

According to this embodiment, the wire connecting portion 22 is provided on the one longitudinal side of the female terminal fitting 62. The concave connecting portion 58 open toward the other longitudinal side is formed on the other longitudinal side of the female terminal fitting 62. Further, the case 60 is disposed on the side opposite to the wire connecting portion 22 with respect to the connecting portion 58 in the longitudinal direction of the female terminal 56 and assembled with the female terminal fitting 62. The convex central part 68*a* of the pressing member 68 and the concave connecting portion 58 are positioned and held across the male terminal insertion gap 51 in the longitudinal direction of the female terminal 56. The pressing member 68 is biased toward the connecting portion 58 by the coil spring 50 accommodated and arranged in a compressed state between the wall portion 36 of the case 60 and the pressing member 68. In this way, even if the maximum outer diameter d of the pin-like male terminal 70 is large, a stacking structure of the pressing member 68 and the coil spring 50 in a direction orthogonal to an extending direction of a wire 24 as in the above first embodiment can be avoided. Therefore, a structure of the female terminal 56 with a suppressed height can be advantageously realized.

Further, since the male terminal insertion opening 54 is open in the direction orthogonal to the longitudinal direction of the female terminal 56, the male terminal 70 can be assembled with the female terminal 56 from a lateral side. In this way, stable connection between the female terminal 56 and the male terminal 70 with a high contact pressure can be ensured while a height reduction of the female terminal 56 is realized. Further, since the connecting portion 58 is formed into a concave shape, the connecting portion 58 can stably hold the pin-like male terminal 70 while a contact area with the male terminal 70 is reliably ensured. In addition, the female terminal fitting 62 can be easily formed by bending the unillustrated strip-like flat plate fitting. The concave connecting portion 58 is provided in a central part of the wall portion of the end edge part on the other longitudinal side of the female terminal fitting 62, and current paths pass through both sides in the length direction (vertical direction in FIG. 8) of the wall portion and are overlapped in the wire connecting portion 22. In this way, a larger current can flow by increasing a cross-sectional area of the current path while the weight of the female terminal fitting 62 is reduced and the strength of the female terminal fitting 62 is ensured.

Figure 11:
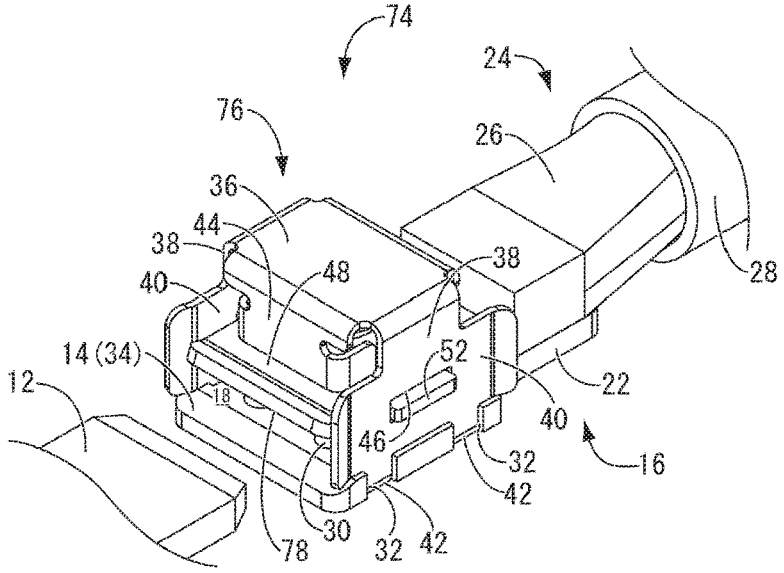
FIG. 11 is an overall perspective view showing a female terminal as a third embodiment of the present disclosure.
Figure 12:
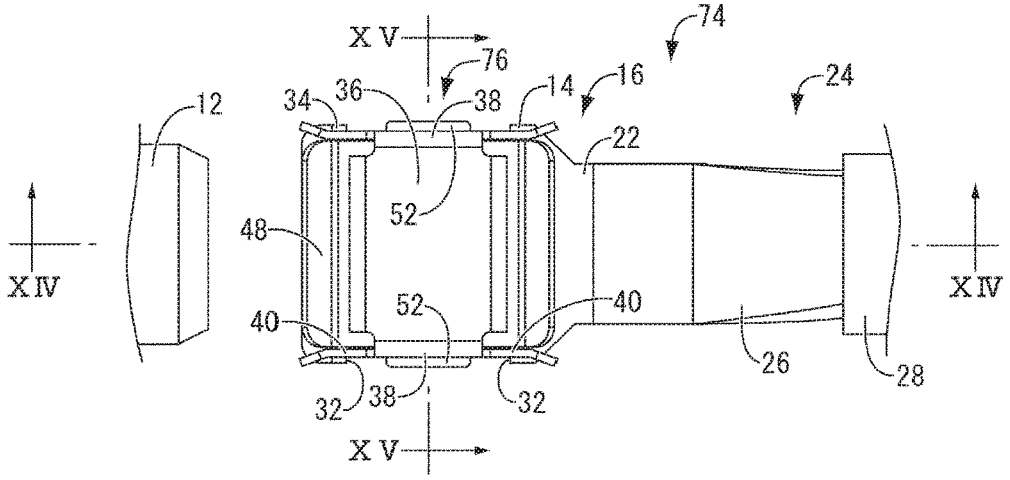
FIG. 12 is a plan view of the female terminal shown in FIG. 11.
Figure 13:
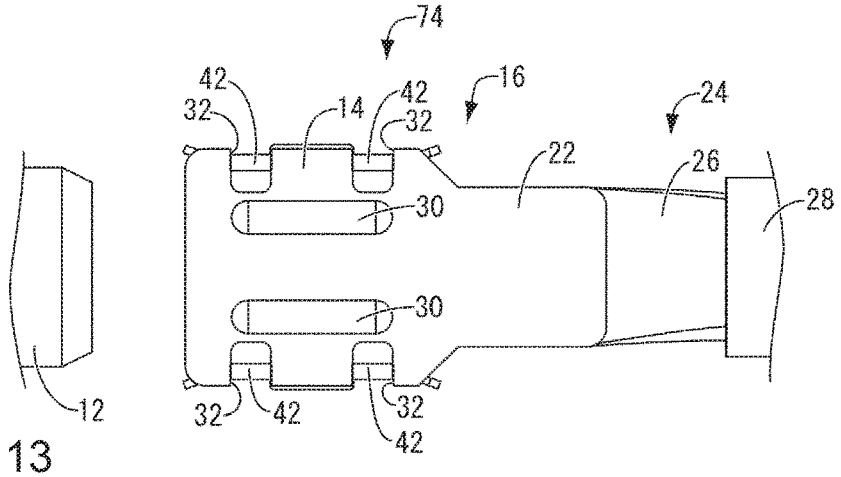
FIG. 13 is a bottom view of the female terminal shown in FIG. 11.
Figure 14:
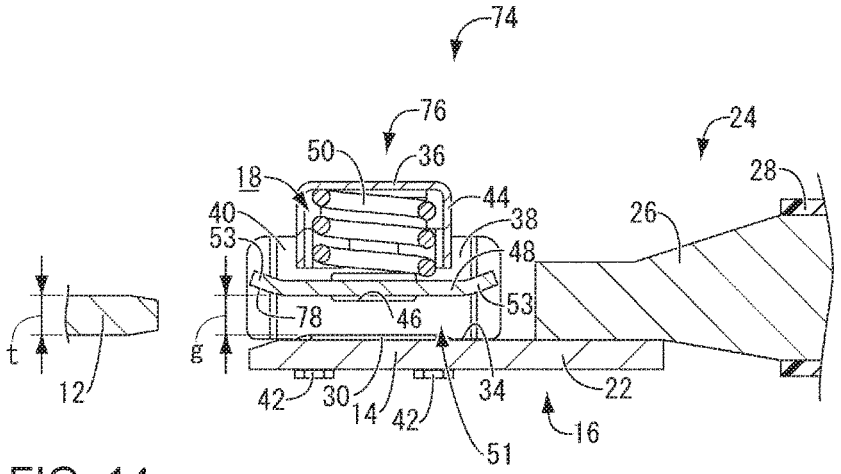
FIG. 14 is a section along XIV-XIV in FIG. 12.
Figure 15:
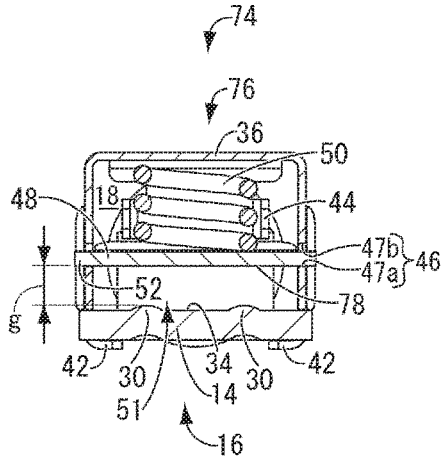
FIG. 15 is a section along XV-XV in FIG. 12.
Figure 16:
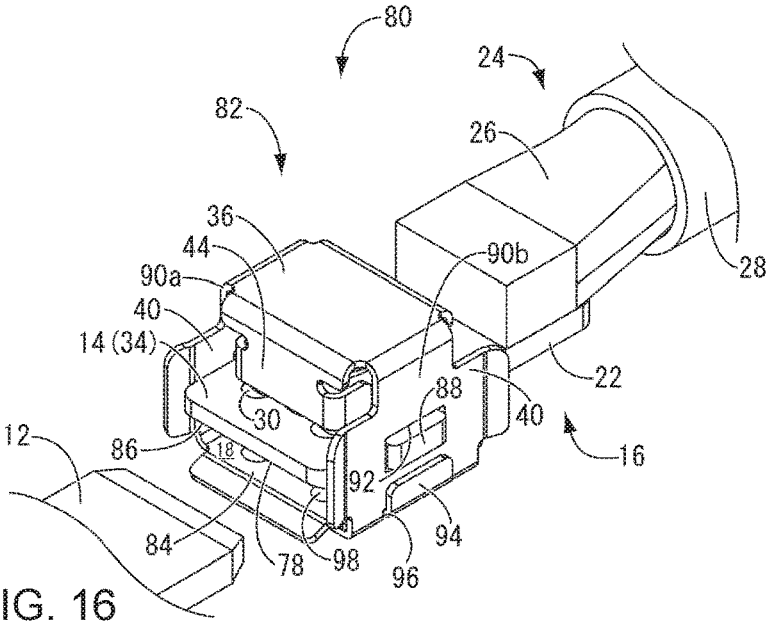
FIG. 16 is an overall perspective view showing a female terminal as a fourth embodiment of the present disclosure.
Figure 17:
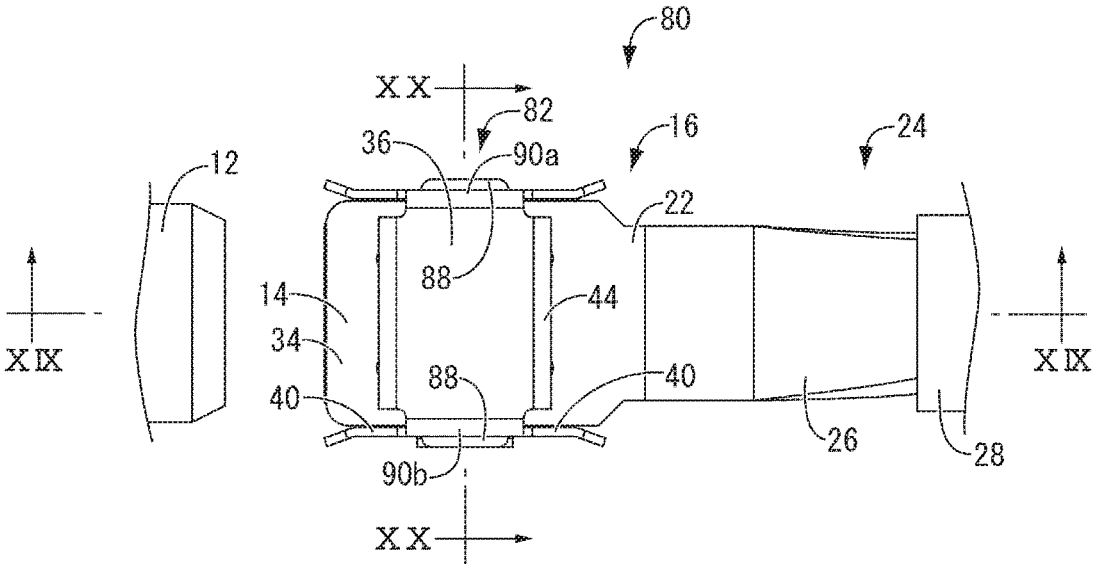
FIG. 17 is a plan view of the female terminal shown in FIG. 16.
Figure 18:
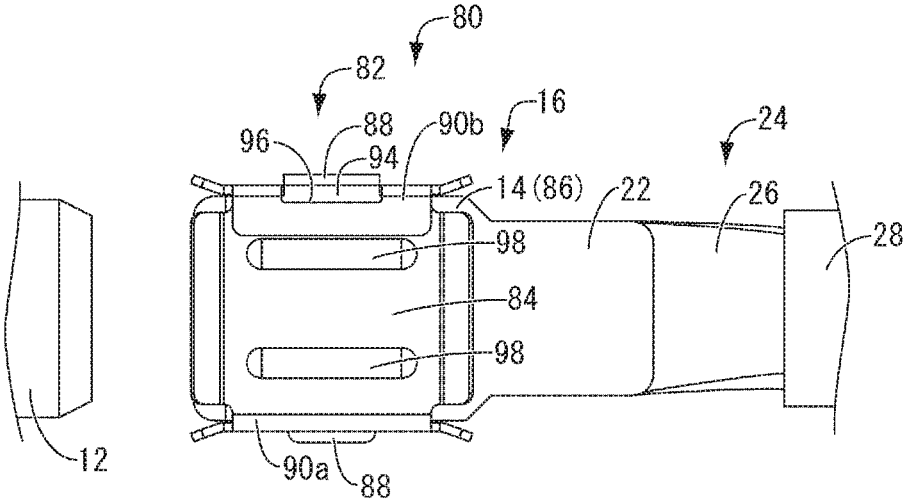
FIG. 18 is a bottom view of the female terminal shown in FIG. 16.

Next, a female terminal 74 as a third embodiment of the present disclosure is described in detail using FIGS. 11 to 15. Members and parts structured as in the above embodiments are denoted by the same reference signs as in the above embodiments in figures and not described in detail. This embodiment differs from the first and second embodiments in that a male terminal insertion opening 78 of a case 76 is open forward in a longitudinal direction of the female terminal 74 (toward an oblique left-lower side in FIG. 11). As a result, a male terminal 12 can be assembled from the front (left in FIG. 12) of the female terminal 74. In addition to the assembling of the male terminal 12, 70 with the female terminal 10, 56 from the lateral side in the above first and second embodiments, the male terminal 12 can be assembled with the female terminal 74 from front. The present disclosure can deal with various assembling structures. More particularly, in the case 76 of this embodiment, a pair of wall portions 38, 38 extend downward from both side edge parts in a width direction (vertical direction in FIG. 12) of a wall portion 36 facing a connecting portion 14. An accommodation space 18 open on both sides in a longitudinal direction (lateral direction in FIG. 12) of the female terminal 74 is configured by the wall portion 36 and the pair of wall portions 38, 38. With a coil spring 50 accommodated and arranged in coil spring holding frames 44 provided on the wall portion 36 of the case 76, a pressing member 48 is inserted into the accommodation space 18 while pushing extending end parts of the pair of wall portions 38, 38 of the case 76 wider apart. In this way, engaging projections 52 of the pressing member 48 are engaged with engaging windows 46 of the case 76 to finish the case 76 in which the pressing member 48 and the coil spring 50 are accommodated and arranged. Finally, the case 76 is assembled on a surface 34 of the connecting portion 14 of the female terminal 74. Specifically, crimping projections 42 provided on the extending end parts of the pair of wall portions 38, 38 of the case 76 are bent inwardly in the width direction and crimped after being inserted into cutout portions 32 of the connecting portion 14, whereby the case 76 is fixed with leg portions 40 of the case 76 placed on the surface 34 of the connecting portion 14. As a result, as shown in FIG. 11, the male terminal insertion opening 78 of the case 76 is formed to be open forward in the longitudinal direction of the female terminal 74 (toward the oblique left-lower side in FIG. 11).

Also in the female terminal 74 of this embodiment thus structured, the pressing member 48 is biased toward the connecting portion 14 by the coil spring 50 as in the above first embodiment. Therefore, the male terminal 12 inserted and arranged in a male terminal insertion gap 51 can be pressed against and held on the connecting portion 14 with a high contact pressure. Further, the pressing member 48 and the coil spring 50 are assembled with the female terminal 74 in advance. Thus, a separate spring member or the like needs not be mounted after the conductive connection of the male terminal 12 as before, and a high contact pressure between the male terminal 12 and the female terminal 74 can be realized by excellent workability. In addition, the pressing member 48 and the connecting portion 14 are held at positions (in states) across the male terminal insertion gap 51 against a biasing force of the coil spring 50. A gap dimension g of the male terminal insertion gap 51 is slightly smaller than a plate thickness t of the male terminal 12. In this way, the amount of displacement of the pressing member 48 in a direction away from the connecting portion 14 is small and the amount of work is small when the male terminal 12 is press-fit and inserted into the male terminal insertion gap 51, and an insertion force at the time of inserting the male terminal 12 into the male terminal insertion gap 51 can be advantageously reduced.

Figure 19:
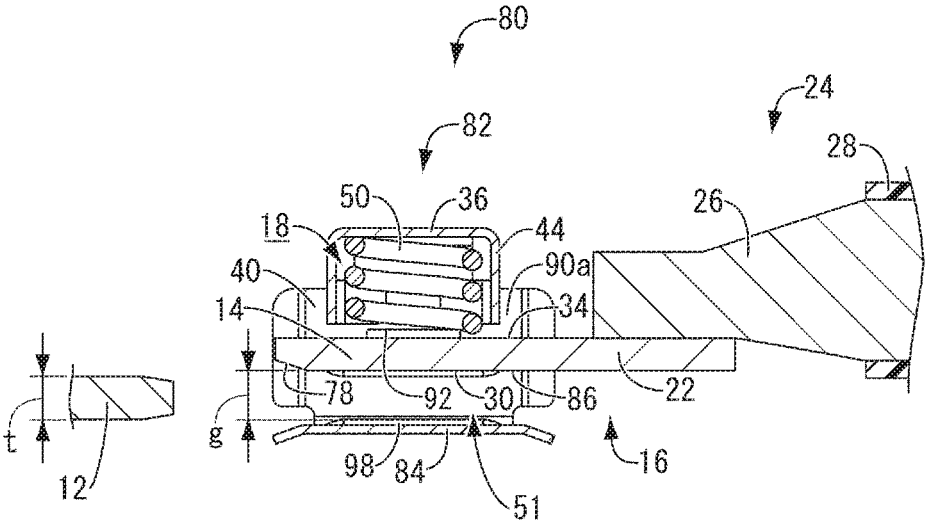
FIG. 19 is a section along XIX-XIX in FIG. 17.
Figure 20:
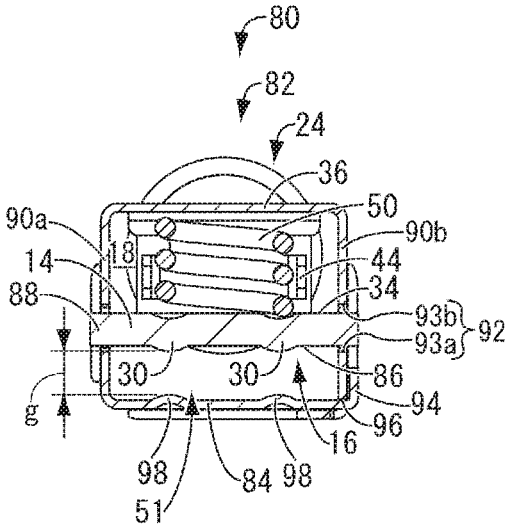
FIG. 20 is a section along XX-XX in FIG. 17.

Further, a female terminal 80 as a fourth embodiment of the present disclosure is described in detail using FIGS. 16 to 20. Members and parts structured as in the above embodiments are denoted by the same reference signs as in the above embodiments in figures and not described in detail. This embodiment differs from the above third embodiment in that a connecting portion 14 of a female terminal fitting 16 is accommodated and arranged in an accommodation space 18 of a case 82 assembled with the female terminal fitting 16 and a facing member includes a wall portion 84 of the case 82. More particularly, as shown in FIGS. 19 and 20, an underside 86, which is one surface of the connecting portion 14 of the female terminal fitting 16 accommodated in the accommodation space 18 of the case 82, faces the wall portion 84 of the case 82 across a male terminal insertion gap 51. A surface 34, which is the other surface of the connecting portion 14, faces another wall portion 36 of the case 82 across a gap. A coil spring 50 serving as a biasing means is accommodated and arranged in a compressed state between the connecting portion 14 and the other wall portion 36 of the case 82. The connecting portion 14 is biased toward the wall portion 84 of the case 82 by the coil spring 50. Further, the connecting portion 14 of the female terminal fitting 16 is displaceable in a direction away from the wall portion 84 of the case 82 against a biasing force of the coil spring 50. Engaging projections 88 substantially in the form of rectangular flat plates projecting outward in a width direction (vertical direction in FIGS. 17 and 18) of the connecting portion 14 from both side edge parts in the width direction of the connecting portion 14 are engaged with engaging windows 92 provided in a pair of wall portions 90*a*, 90*b* of the case 82, thereby configuring an approach displacement restricting means.

In assembling the case 82 with the connecting portion 14 in this embodiment, the coil spring 50 is first accommodated and held in coil spring holding frames 44 of the case 82. Subsequently, a tip side of the connecting portion 14 is inserted into the accommodation space 18 while pushing extending end parts of the pair of wall portions 90*a*, 90*b* of the case 82 wider apart. Specifically, the engaging projections 88 of the connecting portion 14 are engaged with end edge parts 93*a* of the engaging windows 92 of the case 82 on the side of the wall portion 84. In this way, the accommodation space 18 in which the coil spring 50 is accommodated and arranged in a compressed state is formed between the wall portion 36 of the case 82 and the connecting portion 14. Further, an excessive displacement between the female terminal 80 and the male terminal 12 due to vibration or the like is suppressed and the detachment and the like of the male terminal 12 are prevented by the contact of the engaging projections 88 of the connecting portion 14 with end edge parts 93*b* of the engaging windows 92 on a side distant from the wall portion 84. Subsequently, after the wall portion 90*a* on one widthwise side (left side in FIG. 20) of the case 82 is bent toward the wall portion 90*b* on the other side (right side in FIG. 20), an engaging projection 94 substantially in the form of a flat plate provided on a tip part of the wall portion 90*a* is inserted into a through hole 96 provided in the wall portion 90*b* and bent upwardly to come into contact with the outer surface of the wall portion 90*b*. As a result, the wall portion 84, which is the facing member, is configured by a part of the wall portion 90*a* facing the connecting portion 14 in a biasing direction of the connecting portion 14 by the coil spring 50. Note that the wall portion 84, which is the facing member, is provided with a pair of embossed parts 98, 98 extending in a longitudinal direction (lateral direction in FIG. 19) of the female terminal 80 and separated in a width direction (vertical direction in FIG. 18) of the female terminal 80. Each embossed portion 98 has a substantially rectangular shape in a bottom view shown in FIG. 18. Finally, a tip part of the other wall portion 90*b* is bent toward the one wall portion 90*b* (left side in FIG. 20) to come into contact with the outer surface of the wall portion 90*a* in the through hole 96, whereby the assembling of the case 82 with the connecting portion 14 is completed.

According to this embodiment, the underside 86, which is one surface of the connecting portion 14 of the female terminal fitting 16 accommodated in the accommodation space 18 of the case 82, faces the wall portion 84 of the case 82 across the male terminal insertion gap 51, and the surface 34, which is the other surface of the connecting portion 14, faces the other wall portion 36 of the case 82 across the gap. The coil spring 50 serving as the biasing means is accommodated and arranged in a compressed state between the connecting portion 14 and the other wall portion 36 of the case 82. In this way, the connecting portion 14 is biased toward the wall portion 84 of the case 82 by the coil spring 50. Therefore, also in this embodiment, the male terminal 12 can be reliably pressed against the connecting portion 14 by a biasing force of the coil spring 50 in the male terminal insertion gap 51 as in the other embodiments. In this way, the male terminal 12 can be stably pressed against the female terminal fitting 16 with a wider contact area, particularly when the male terminal 12 has a flat plate shape as in this embodiment. A contact pressure between the female terminal 80 and the male terminal 12 can be reliably improved, and the female terminal 80 and the male terminal 12 can be conductively connected with even less resistance.

Further, the connecting portion 14 is accommodated and arranged in the accommodation space 18 of the single case 82. The coil spring 50 can be compressed and the wall portion 84, which is the facing member, is formed, utilizing the pair of wall portions 90*a*, 90*b* of the case 82. Therefore, the female terminal 80 can be compactly formed. Further, the connecting portion 14 of the female terminal 80 is directly pressed against the male terminal 12 by the coil spring 50. In this way, the connecting portion 14 can better follow the male terminal 12 when the male terminal 12 is displaced, for example, due to vibration when a vehicle is driven. Therefore, the connecting portion 14 of the female terminal 80 can be advantageously brought into contact with the male terminal 12 with a wide area while the occurrence of one-side contact of the male terminal 12 with the connecting portion 14 of the female terminal 80 and the like are advantageously avoided. Thus, connection stability between the female terminal 80 and the male terminal 12 can be improved.

Although a plurality of the embodiments of the present disclosure have been described in detail above, the present disclosure is not limited by the specific description of these embodiments. For example, although the coil spring 50 is illustrated as the biasing means in the above embodiments, the biasing means is not limited to this and, for example, any of known members for applying a biasing force such as spring members including leaf springs and disc springs and elastic bodies including rubber elastic bodies can be employed as such. Further, although the pressing member 48, 68 and the coil spring 50 are indirectly held on the female terminal fitting 16, 62 via the case 20, 60, 76 in the above embodiments, these may be directly held. Furthermore, although the case 20, 60 and the pressing member 48, 68 are made of metal in the above embodiments, members having a sufficient rigidity may be used and materials such as synthetic resin can be employed. In addition, although one of the pressing member 48, 68 and the connecting portion 14 is biased by the coil spring 50 in the above embodiments, the both may be biased by the coil spring 50. Since the coil spring 50 can be reduced in size and easily manufactured in this way, a cost reduction is possible. Further, an inserting direction of the male terminal 12, 70 into the male terminal insertion gap 51 can be arbitrarily set according to a request such as the disposed position of the female terminal 10, 56, 74, 80 and may be, for example, the same as or orthogonal to the extending direction of the wire 24 to be connected to the female terminal 10, 56, 74, 80.

The invention claimed is:

1. A female terminal, comprising:

a female terminal fitting including a connector to be conductively connected to a male terminal;

a facing member held on the female terminal fitting, the facing member being arranged to face the connector across a male terminal insertion gap into which the male terminal is inserted;

a spring held on the female terminal fitting, the spring biasing at least one of the facing member and the connector toward the other; and an approach displacement restricting device that maintains the male terminal insertion gap by restricting a displacement in an approaching direction between the facing member and the connector, wherein:

the male terminal is press-fit into the male terminal insertion gap to be disposed between the connector and the facing member by allowing a displacement in a separating direction between the connector and the facing member against a biasing force of the spring, the female terminal further comprises a case assembled with the female terminal fitting and including an accommodation space, the spring is held on the female terminal fitting by being accommodated in the accommodation space of the case, and the approach displacement restricting device includes an engaging projection provided on at least one of the facing member and the connector biased toward the other by the spring and an engaging window penetrating through a wall of the case, and the displacement in the approaching direction between the facing member and the connector is restricted by an engagement of the engaging projection with the engaging window.

2. The female terminal of claim 1, wherein:

the facing member includes a pressing member held on the female terminal fitting, the pressing member is arranged to face the connector of the female terminal fitting across the male terminal insertion gap and biased toward the connector by the spring, and the pressing member is displaceable in a direction away from the connector against the biasing force.

3. The female terminal of claim 2, wherein:

the pressing member and the spring are held on the female terminal fitting by being accommodated in the accommodation space of the case, and the approach displacement restricting device includes the engaging projection provided on the pressing member and the engaging window penetrating through the wall of the case and extending a predetermined length in a facing direction of the pressing member and the connector, and an end edge part of the engaging window on a side of the connector is set at a position separated from the connector across the male terminal insertion gap, whereas the engaging projection of the pressing member is biased and engaged with the end edge part.

4. The female terminal of claim 3, wherein:

the female terminal fitting has a rectangular flat plate shape, a wire connector is provided on one side in a longitudinal direction of the female terminal fitting and a part of the female terminal fitting closer to the other longitudinal side than the wire connector serves as the connector, the case is assembled on a surface of the connector of the female terminal fitting, the case includes the wall facing the connector via the accommodation space and the flat pressing member accommodated and arranged in the accommodation space is positioned and held above and in parallel to the connector across the male terminal insertion gap, the spring is accommodated and arranged in a compressed state between the wall of the case and the pressing member and the engaging projection of the pressing member is biased toward the end edge part of the engaging window on the side of the connector, and the male terminal insertion gap communicates with outside via a male terminal insertion opening provided in the case.

5. The female terminal of claim 4, wherein the male terminal insertion opening of the case is open in a direction orthogonal to the longitudinal direction of the female terminal fitting.

6. The female terminal of claim 4, wherein an edge of the pressing member projects outward from the male terminal insertion opening provided in the case and bent in the direction away from the connector.

7. The female terminal of claim 3, wherein:

a wire connector is provided on one longitudinal end edge part of the female terminal fitting and the connector having a concave shape and open toward the other longitudinal side is provided on the other longitudinal end edge of the female terminal fitting, the case is disposed on a side opposite to the wire connector with respect to the connector in the longitudinal direction and assembled with the female terminal fitting, the case includes the wall facing the connector via the accommodation space, and the pressing member accommodated and arranged in the accommodation space is positioned and held across the male terminal insertion gap in the longitudinal direction with respect to the connector, the spring is accommodated and arranged in a compressed state between the wall of the case and the pressing member and the engaging projection of the pressing member is biased toward the end edge part of the engaging window on the side of the connector, and the male terminal insertion gap communicates with outside via a male terminal insertion opening located between the pressing member and the connector in the longitudinal direction, provided in the case and open in a direction orthogonal to the longitudinal direction.

8. The female terminal of claim 7, wherein:

the female terminal fitting is formed by bending a flat plate fitting and the wire connector is formed by overlapping longitudinal end edge parts of the flat plate fitting, and the other longitudinal end edge part of the female terminal fitting is formed into a tubular shape in a side view and the connector having the concave shape is formed by concavely recessing a wall defining an end surface on the other longitudinal side of the female terminal fitting.

9. The female terminal of claim 1, wherein:

the connector of the female terminal fitting is accommodated and arranged in the accommodation space of the case assembled with the female terminal fitting and the facing member includes the wall of the case, the connector of the female terminal fitting is arranged to face the wall of the case across the male terminal insertion gap and biased toward the wall by the spring, and the connector of the female terminal fitting is displaceable in a direction away from the wall of the case against the biasing force.

10. The female terminal of claim 9, wherein:

the female terminal fitting has a rectangular flat plate shape, a wire connector is provided on one side in a longitudinal direction of the female terminal fitting and a part of the female terminal fitting closer to the other longitudinal side than the wire connector serves as the connector, one surface of the connector of the female terminal fitting accommodated in the accommodation space of the case faces the wall of the case across a gap and the other surface of the connector faces another wall of the case across a gap, the spring is accommodated and arranged in a compressed state between the connector and the other wall of the case and the connector and the wall of the case are arranged to face each other across the male terminal insertion gap, and the connector is biased toward the wall of the case by the spring.

11. The female terminal of claim 1, wherein the spring includes a coil spring.

* * * * *